United States Patent [19]

Minneman

[11] Patent Number: 4,467,947

[45] Date of Patent: Aug. 28, 1984

[54] CONTAINER FOR CYLINDRICAL OBJECTS

[76] Inventor: William J. Minneman, c/o MTM Molded Products Company 5680 Webster St., Dayon, Ohio 45414

[21] Appl. No.: 527,135

[22] Filed: Aug. 29, 1983

[51] Int. Cl.[3] ..... F42B 39/00; B65D 43/16

[52] U.S. Cl. ..... 224/253; 224/239; 206/3; 206/366; 206/379

[58] Field of Search ..... 224/253, 225, 239, 914, 224/918; 206/3, 257, 261, 366, 379

[56] References Cited

U.S. PATENT DOCUMENTS

| | | | |
|---|---|---|---|
| 243,144 | 6/1881 | MacConnell | 224/239 X |
| 776,402 | 11/1904 | Johnson | 206/366 |
| 2,877,891 | 3/1959 | Chartrand | 206/3 |
| 3,236,366 | 2/1966 | Broda et al. | 206/379 |
| 3,777,954 | 12/1973 | Theodore | 224/253 X |
| 3,923,152 | 12/1975 | Minneman | 206/3 |

*Primary Examiner*—Steven M. Pollard
*Attorney, Agent, or Firm*—Biebel, French & Nauman

[57] ABSTRACT

A container for securing carrying therein a plurality of substantially cylindrical objects includes a housing having cooperating base and cover portions. A first hinge connects the base and cover, the housing being openable and closable by pivotal movement of the portions about the first hinge. A first object support member is connected by a second hinge to the interior of the base portion, and a second object support member is connected by a third hinge to the interior of the cover portion, both second and third hinges being substantially parallel to the first hinge. The first and second support members are further connected together along a portion of the each of the members, and object securing means is carried on at least one of the support members for removably securing a plurality of objects along the member.

14 Claims, 7 Drawing Figures

CONTAINER FOR CYLINDRICAL OBJECTS

BACKGROUND OF THE INVENTION

The present invention relates to a container for securely carrying therein a plurality of substantially cylindrical objects, and, more particularly, to such a container that is adapted for carrying spare rounds of ammunition.

Many firearms, particularly rifles and shotguns, must be continuously reloaded during extended periods of use. Due to the adverse weather conditions and rough terrain in which shooting activities such as hunting are often conducted, it is necessary to carry the spare rounds of ammunition used for reloading so that the rounds are protected from dirt, moisture, and the like. Even so, it is important to the shooter to have the spare rounds carried in such a manner that they are easily accessible. Moreover, in hunting and other shooting activities, it is sometimes necessary to reload the firearm quickly. In such a case, the rounds must be positioned where they can be easily grasped by the shooter for rapid reloading.

What is needed, therefore, is a means for carrying spare rounds of ammunition that protects the rounds while presenting them to the shooter in a manner faciliating quick and convenient loading.

SUMMARY OF THE INVENTION

The present invention provides a closable container for securely carrying therein a plurality of substantially cylindrical objects, in particular spare rounds of ammunition. The container includes a housing having cooperating base and cover portions connected by a first hinge. The housing is thus openable and closable by pivotal movement of its parts about this hinge.

A first object support member is connected by a second hinge to the interior of the base portion substantially near the first hinge so that the second hinge substantially parallel to the first hinge. Similarly, a second object supporting member is connected by a third hinge to the interior of the cover portion substantially near the first hinge, with the third hinge again substantially parallel to the first hinge. The first and second members are further connected together along a portion of each of the members. Object securing means is carried on at least one of the members for movably securing a plurality of objects along that member.

The base and cover portions and the first hinge may be molded from a plastic material as an integral structure. The first and second members, the second and third hinges, and the object securing means, are molded from a plastic material as an integral structure. The two structures are then joined together.

The object securing means may be adapted to secure the cylindrical objects substantially perpendicular to the first hinge. Moreover, the object securing means may include a plurality of sockets, with one object being insertable into each of the sockets.

The container may further include a closure means having a latch means carried on one of the housing portions and a cooperating catch means carried on the other housing portion. Additionally, means for attaching the housing to a strap-like member, such as a belt, may be provided including a shallow U-shaped member having a base and two relatively short upright portions, the ends of both upright portions opposite the base being connected to the exterior surface of one of the housing portions.

Use of such a container for spare ammunition rounds by a shooter is advantageous in that the rounds are protected from exposure to dirt or moisture, and yet may be easily carried on a belt worn by the shooter to place the rounds within easy reach. The container is easily openable, while the hingedly mounted object support members and object securing means present the rounds to the shooter in a position where they may be easily removed from the container. By molding the container from a plastic material as a pair of integral units, the container can be relatively simply and inexpensively manufactured, thereby enabling the shooter to enjoy the advantages of such a container at relatively low cost.

Accordingly, it is an object of the present invention to provide a container for securely carrying therein a plurality of substantially cylindrical objects, particularly rounds of ammunition, wherein the objects, upon opening the container, are presented in a manner facilitating quick and easy removal of the objects from the container; to provide such a container which may be easily opened and closed; to provide such a container which may be worn on a belt; to provide such a container which protects the objects when carried therein; and to provide such a container which may be manufactured relatively simply and inexpensively.

Other objects and advantages of the present invention will be apparent from the following description, the accompanying drawings, and the appended claims.

BRIEF DESCRIPTION OF THE PREFERRED EMBODIMENTS

Figure 1:
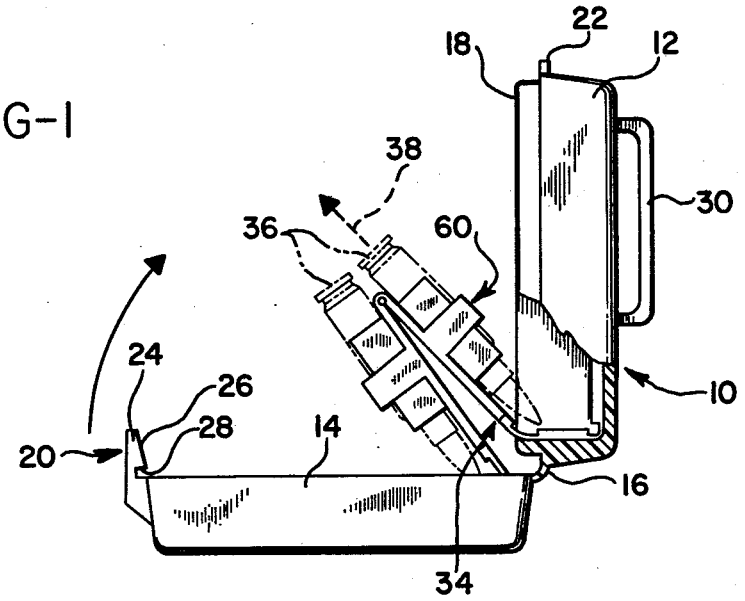
FIG. 1 is a side elevation view of the container of the present invention when partially opened, with a portion of the housing broken away to show positioning of rounds carried within the container.

Referring generally to FIG. 1, the container of the present invention is shown partially opened. A housing or box 10 includes cooperating base 12 and cover 14, joined together by an integral hinge means 16 so they may be pivoted about the hinge for opening and closing of housing 10. An inner flange 18 is provided around the edge of base 12 for cooperation with the edge of cover 14 when housing 10 is closed to provide a generally dirt and moisture resistant seal for the compartment within the interior of housing 10. The outer surfaces of base 12 and cover 14 are preferably formed with a slightly roughened texture for appearance and to facilitate gripping of housing 10.

Figure 2:
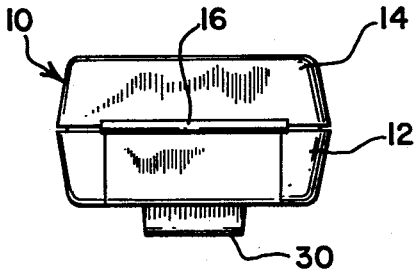
FIG. 2 is an end elevation view of the container when closed.

The base 12, cover 14, and hinge 16 are preferably molded as unit from a plastic material, such as a polyvinyl plastic. As seen in FIG. 2, hinge 16 is therefore a unitary hinge formed from the same material as the base and cover, although of a thickness less than that of the housing walls.

Referring back to FIG. 1, a closure means for holding housing 10 in a closed position is provided in the form an integral flexible latch 20 on cover 14 and catch means formed by tab 22 on base 12. Latch 20 includes a projection 24 having an inclined ramp-like surface 26 and a slot 28 defined in projection 24. Tab 22 is of an appropriate size to fit within and cooperate with slot 28 to hold housing 10 closed. Since latch 20 is formed integrally with housing 10 from the same plastic material, and is therefore slightly flexible, projection 24 may be lifted or pushed over tab 22 as housing 10 is closed to engage tab 22 within slot 28. The resilient nature of latch 20 then holds tab 22 within slot 28.

Figure 3:
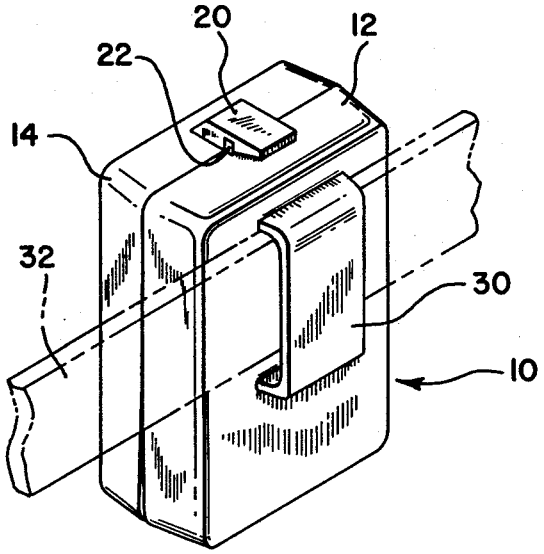
FIG. 3 is perspective view of the closed container showing the container mounted to a belt.

The housing 10 may be attached to a strap-like member, such as a belt, by a shallow U-shaped loop member 30 molded as part of the base 12. The two relatively short upright portions of member 30 extend from the exterior surface of base 12, thereby forming an open sided loop through which a belt 32 may be inserted as shown in FIG. 3.

Referring briefly again to FIG. 1, an inner object holding or support structure 34 is carried within housing 10, and includes means for supporting and retaining rounds 36 within housing 10. The rounds 36 are held such that upon opening of housing 10. The holding structure is raised and rounds 36 may be easily removed, as indicated by arrow 38.

Figure 4:
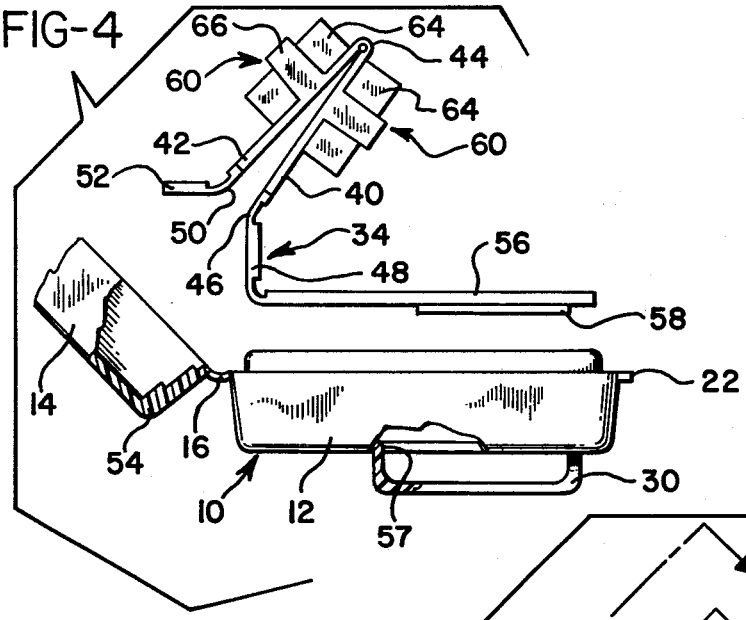
FIG. 4 is an exploded, side elevation view of the container showing the two integral structures from which it is assembled.

The inner structure 34 may be seen in detail in the exploded view of FIG. 4, and is molded from the same plastic material as the outer structure forming housing 10, including a pair of object supporting members 40 and 42 formed substantially in the shape of flat plates. Members 40 and 42 are connected together by a thin portion 44 of plastic material, serving as a hinged connection. In addition, member 40 is attached by integral hinge 46 to mounting portion 48, while supporting member 42 is attached by integral hinge 50 to mounting portion 52.

Inner structure 34 is mounted within housing 10 by securing mounting portions 48 and 52 to the interior of base 12 and cover 14, respectively. Attachment is made by adhesive, heat welding, or a combination of both. To facilitate proper location of mounting portion 52 within the housing interior, the interior surface of portion 14 is provided with a bi-level raised step 54 onto which portion 52 is secured. Mounting portion 48 on the other hand, is attached to an enlongated member 56 which is secured to the interior of base 12 and serves in part to properly locate mounting portion 48.

To facilitate molding of the outer structure, and in particular housing base 12 and loop member 30, an opening 57 in base 12 is formed in that area which is essentially covered by loop member 30. Member 56 is molded with a raised area 58 which is then fittable within the opening 57 in base 12 when inner structure 34 is secured within housing 10, to close the opening 57 and provide an essentially contiguous surface for the exterior of base 12.

An object securing means 60 is carried on each of support members 40 and 42 for securing a plurality of rounds onto the surface of the support member.

It will be recognized from FIG. 1 that the hinges 46 and 50 by which members 40 and 42, respectively, are attached to housing 10 will result in the members 40 and 42 being held approximately midway between the base and cover regardless of the degree to which housing 10 is opened. Thus, any rounds which may be carried within securing means 60 will be presented for easy removal from housing 10 upon the opening thereof.

Figure 5:
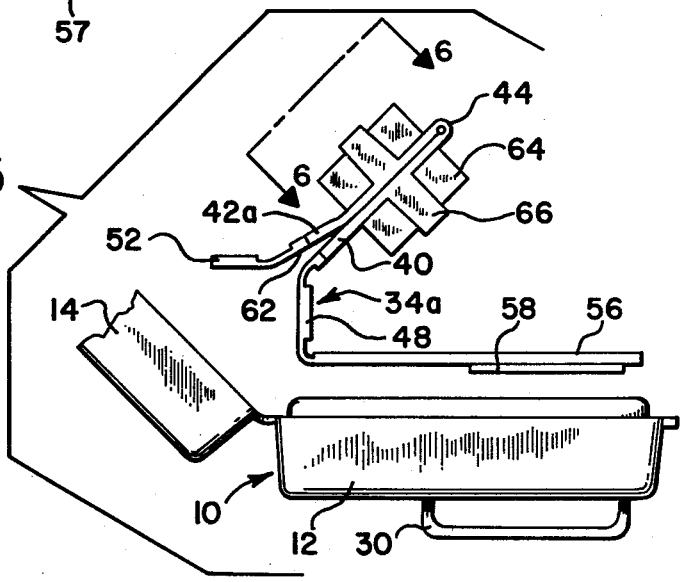
FIG. 5 is a view similar to FIG. 4 showing an alternate embodiment for the inner integral structure.

An alternate embodiment for the inner structure is shown as structure 34*a* in FIG. 5. Structure 34*a* is quite similar to structure 34, with the exception that support 42*a* is constructed with a curved portion 62 so that part of support member 42*a* is in continuous contact with support member 40. The contacting part of member 42*a* is secured to member 40 by adhesive, heat welding, or a combination of both, so that as housing 10 is opened, hinged movement between members 40 and 42*a* occurs through bending of member 42*a* around curved portion 62. Of course, such an embodiment is made possible through the use of the slightly flexible material from which inner structure 34*a* is formed. It will also be recognized that further embodiment similar to that shown in FIG. 5 are possible. For example, rather than distinct members 40 and 42*a*, the joined sections thereof shown in FIG. 5 may be formed as a single piece. The section of member 42*a* movable with respect to member 40 may then be molded as a separate member joined by an integral hinge, or as an additional portion of the single piece.

Figure 6:
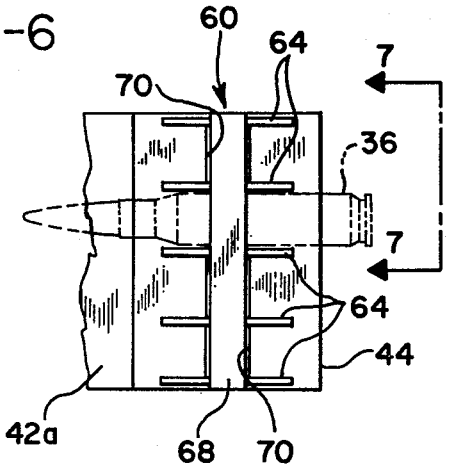
FIG. 6 is a view of the object securing means taken generally along line 6—6 of FIG. 5.
Figure 7:
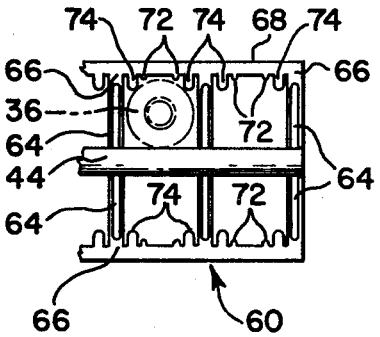
FIG. 7 is a view taken generally along the line 7—7 of FIG. 6.

The object securing means 60 is shown in detail in FIGS. 6 and 7. In the preferred embodiment, each securing means 60 is adapted to secure four rounds, although the container and/or its parts may be sized to provide a securing means for any desired number of rounds. A plurality of parallel dividers 64, the number of such dividers 64 exceeding by one the maxium number of rounds to be secured, are provided across the outer surface of support member 42*a*. Each divider 64 includes a central extension 66 of a height greater than that of the supporting divider 64. Extensions 66 in turn support cross member 68, which connects each of extensions 66, thereby forming a plurality of sockets or compartments.

To facilitate molding of inner structure 34, an opening 70 is provided in the surface of support member 42*a* immediately beneath cross member 68.

As seen in FIG. 7, the lower surface of cross member 68 is provided with a plurality of downward projections 72 and 74. To secure a round 36 within securing means 60, the round is inserted between an adjacent pair of dividers 64 and beneath cross member 68. Thus, it will be recognized that dividers 64, extensions 66, and projections 72 and 74 are sized and spaced appropriately to secure round 36 in place. It will be further relized that the dimensions of inner structure 34 will therefore be determined by the particular size of rounds that are to be carried within the container.

It should be recognized that the object securing means 60 shown in either of FIGS. 4 or 5 as being carried on and of support members 40 and 42 are identical to that described herein as carried on support member 42*a*.

While the form of apparatus herein described constitutes a preferred embodiment of this invention, it is to be understood that the invention is not limited to this precise form of apparatus, and that changes may be made therein without departing from the scope of the invention, which is defined in the appended claims.

What is claimed is:

1. A container for securely carrying therein a plurality of substantially cylindrical objects, comprising:

a housing having cooperating base and cover portions, each said portion having an interior and exterior surface;

first hinge means connecting said base and cover portions and defining a first hinge line, said housing being openable and closable by pivotal movement of said portions about said first hinge line;

first and second object support members;

second and third hinge means connecting said first and second support members to the interior of said base and cover portions, respectively, substantially near said first hinge means and defining second and third hinge lines substantially parallel to said first hinge line;

said first and second support members further being connected together along a portion of each of said support members; and object securing means carried on at least one of said support members for removably securing a plurality of objects along said member.

2. The container as defined in claim 1 further comprising fourth hinge means connecting said first and second members and defining a fourth hinge line substantially parallel to said first hinge line.

3. The container as defined in claim 1 wherein said base and cover housing portions are formed from a plastic material.

4. The container as defined in claim 3 wherein said base and cover portions and said first hinge means are formed as an integrally molded unit.

5. The container as defined in claim 1 wherein said first and second object support members and said object securing means are formed from a plastic material.

6. The container as defined in claim 5 wherein said first and second support members, said object securing means, and said second and third hinge means are formed as an integrally molded unit.

7. The container as defined in claim 1 wherein said object securing means is carried on each of said first and second support members.

8. The container as defined in claim 1 wherein said object securing means is adapted to secure the objects in an orientation substantially perpendicular to said first hinge line.

9. The container as defined in claim 8 wherein said object securing means includes a plurality of sockets, one object being insertable into each of said sockets.

10. The container as defined in claim 1 further comprising closure means including latch means carried on one of said housing portions and a cooperating catch means carried on the other of said portions.

11. The container as defined in claim 1 further comprising means for attaching said housing to a strap-like member including a shallow U-shaped member having a base and two relatively short upright portions, the ends of both said upright portions opposite said base being connected to the exterior surface of one of said housing portions.

12. A container for securely carrying therein a plurality of substantially cylindrical objects, comprising:

an outer structure including a housing having cooperating base and cover portions, each said portion having an interior and exterior surface, and first hinge means connecting said base and cover portions and defining a first hinge line, said housing being operable and closable by pivotal movement of said portions about said first hinge line, said outer structure being molded from a plastic material as an integral unit; and an inner structure including first and second object support members, second hinge means attached to said first member and defining a second hinge line, third hinge means attached to said second member and defining a third hinge line, said first and second members being connected together along a portion of each of said members such that said second and third hinge lines are substantially parallel, and object securing means carried on at least one of said members for removably securing a plurality of objects along said member substantially perpendicular to said second and third hinge lines, said inner structure being molded from a plastic material as an integral unit;

said outer and inner structures being attached by connection of said second hinge means to the interior of said base portion substantially near said first hinge means and by connection of said third hinge means to the interior of said cover portion substantially near said first hinge means, such that said first hinge line is substantially parallel to said second and third hinge lines.

13. The container as definined in claim 12 wherein said outer structure further includes latch means carried on one end of said housing portions and a cooperating catch means carried on the other of said portions, and means for attaching said housing to a strap-like member connected to the exterior surface of one of said housing portions.

14. The container as defined in claim 12 wherein attachment of said outer and inner structures is performed by heat welding of the plastic material of said structure.

* * * * *